US006514099B2

(12) United States Patent
Endo

(10) Patent No.: US 6,514,099 B2
(45) Date of Patent: Feb. 4, 2003

(54) HALF-FITTING PREVENTION CONNECTOR

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/146,914

(22) Filed: May 17, 2002

(65) Prior Publication Data

US 2002/0173197 A1 Nov. 21, 2002

(30) Foreign Application Priority Data

May 18, 2001 (JP) ..... 2001-149924

(51) Int. Cl.[7] ..... H01R 3/00
(52) U.S. Cl. ..... 439/489; 439/488; 439/357
(58) Field of Search ..... 439/488, 489, 439/357, 352

(56) References Cited

U.S. PATENT DOCUMENTS 4,657,331 A 4/1987 Coldren
5,192,225 A * 3/1993 Suzuki ..... 439/350
5,348,493 A 9/1994 Power
5,391,087 A * 2/1995 Fukuda ..... 439/188
5,435,742 A 7/1995 Cecil, Jr.
6,012,946 A * 1/2000 Fukase ..... 439/352

FOREIGN PATENT DOCUMENTS

EP 0 484 951 5/1992
JP 8-31517 2/1996

* cited by examiner

*Primary Examiner*—Tho D. Ta
(74) *Attorney, Agent, or Firm*—Sughrue Mion, PLLC

(57) ABSTRACT

When a pair of male and female connector housings (50) and (40) are fitted with each other, a half-fitted state of the male and female connector housings (50,40) can be easily detected according to whether or not a fitting detection member (60) attached over first connector housing (40) is able to slidingly move to a proper-fitting detecting position. In addition, by setting the proper-fitting detecting position of the fitting detection member (60) closer to a rear end of the housing than an initial position, it is possible to perform at a stroke the detection member moving operation for slidingly moving the fitting detection member (60) to the proper-fitting detecting position as well as the housings-pulling and confirming operation for confirming the state of connection of the housings by pulling the male and female connectors (50) and (40) in disengaging directions.

3 Claims, 9 Drawing Sheets

HALF-FITTING PREVENTION CONNECTOR

BACKGROUND OF THE INVENTION

1. Field of the Invention

The present invention relates to a half-fitting prevention connector in which when a pair of male and female connector housings are fitted with each other, a half-fitted state of the male and female connector housings is detected according to whether or not a fitting detection member attached over one connector housing is able to slidingly move to a proper-fitting detecting position.

The present application is based on Japanese Patent Application No. 2001-149924, the entire contents of which are incorporated herein by reference.

2. Related Art

As shown in FIGS. 7 and 8, a conventional half-fitting prevention connector is arranged such that when a pair of male and female connector housings 1 and 9 are fitted with each other, a half-fitted state of the male and female connector housings 1 and 9 is detected according to whether or not a fitting detection member 2 fitted to one connector housing, i.e., the male connector housing 1, is able to slidingly move to a proper-fitting detecting position (reference should be had to JP-A-8-31517).

As shown in FIG. 8, the male connector housing 1 has a flexible lock arm 4 rising upward from a front end side of an upper wall 3 and extending in the rearward direction of the housing, and a lock portion 6 is projectingly provided on an upper surface of an intermediate portion of this flexible lock arm 4.

Further, a pressing plate portion 7, which is an operating portion for flexibly deflecting the flexible lock arm 4 during the fitting of the male and female connector housings, is provided at a free end of the flexible lock arm 4 located close to a rear end of the male connector housing 1.

In addition, the female connector housing 9 has an engaging portion 10 at an inner surface-side front end of an upper wall which is attached over the flexible lock arm 4 when the male and female connector housings 1 and 9 are fitted with each other.

As shown in FIGS. 9 and 10, when the fitting length at the time of the fitting of the male and female connector housings 1 and 9 reaches an appropriate value, the engaging portion 10 rides over the lock portion 6 through the flexural deflection of the flexible lock arm 4. Then, when the length of fitting of the male and female connector housings 1 and 9 has reached the appropriate value, the engaging portion 10 retains the lock portion 6 by engaging a recessed portion 6*a* in the rear of the lock portion 6 from above, thereby locking the fitted state of the male and female connector housings.

As shown in FIGS. 7 and 8, the fitting detection member 2 has a structure in which an operating plate portion 16 which engages the pressing plate portion 7 slidably along the fitting direction of the male and female connector housings, a resilient piece 17 extending from a rear end portion of this operating plate portion 16 toward a front end side of the male connector housing 1, and a positioning portion 20 provided projectingly on a distal end of this resilient piece 17 are integrally molded. The resilient piece 17 has the shape of a rod which is capable of being inserted in a space between a pair of side plate portions 5 making up the aforementioned flexible lock arm 4.

In addition, as shown in FIG. 7, the positioning portion 20 is a projection which can be fitted from below into the recessed portions 6*a* and 6*b* respectively located behind and in front of the lock portion 6 by the urging force of the resilient piece 17. Before the fitting of the male and female connector housings, the positioning portion 20 is retained by a rear edge of the lock portion 6 and its forward movement is restricted in a state in which the positioning portion 20 is engaged in the recessed portion 6*a* in the rear of the lock portion 6.

The position where the positioning portion 20 abuts against the rear edge of the lock portion 6 and its forward displacement is thereby restricted is an initial position of the fitting detection member 2 fitted to the male connector housing 1.

In addition, as for the slidable engagement between the pressing plate portion 7 and the operating plate portion 16, the slidable range is set such that the fitting detection member 2 is slidable between the aforementioned initial position and the proper-fitting detecting position which is set forwardly of the initial position.

As shown in FIG. 10, when the pair of male and female connector housings 1 and 9 are fitted with each other, the length of fitting of the male and female connector housings 1 and 9 reaches an appropriate value, and the engaging portion 10 of the female connector housing 9 is fitted in the recessed portion 6*a* in the rear of the lock portion 6.

In consequence, the positioning portion 20 of the fitting detection member 2 which was engaged in the recessed portion 6*a* is pushed downward by the engaging portion 10, thereby canceling the positional restriction of the positioning portion 20 to its initial position. As a result, if the operating plate portion 16 is pushed forward, the fitting detection member 2 becomes slidable, as shown by arrow A in the drawing.

As shown in FIG. 11, if the fitting detection member 2 is moved forward in the state in which the positional restriction of the positioning portion 20 to its initial position is canceled, the positioning portion 20 advances forward in sliding contact with the lower surfaces of the engaging portion 10 and the lock portion 6. Then, when the positioning portion 20 has moved over the front edge of the lock portion 6, the positioning portion 20 is displaced upward by the urging force of the resilient piece 17, and is fitted in the recessed portion 6*b* in front of the lock portion 6.

In consequence, the positioning portion 20 fitted in the recessed portion 6*b* has its rear end face retained by the front end face of the lock portion 6, thereby assuming a locked state in which the rearwardly sliding movement is restricted.

However, in the case of a half-fitted state in which when the male and female connector housings 1 and 9 are fitted with each other, the length of fitting of the male and female connector housings 1 and 9 does not reach the appropriate value, the engaging portion 10 of the female connector housing 9 does not fit into the recessed portion 6*a* in the rear of the lock portion 6.

For this reason, the positioning portion 20 is not pushed out of the recessed portion 6*a* by the engaging portion 10, and the positional restriction of the fitting detection member 2 to its initial position by the lock portion 6 is not canceled.

Accordingly, when the male and female connector housings are half-fitted with each other, even if the operating plate portion 16 of the fitting detection member 2 is pushed forward, the fitting detection member 2 does not move forward, and the half-fitted state can be detected according to whether or not the fitting detection member 2 can be moved forward.

As the housings-engaging operation for engaging the above-described pair of male and female connector housings 1 and 9, an operator directly holds the respective connector housings 1 and 9 with his or her fingers, and engages both connector housings 1 and 9.

Next, as the detection member moving operation for detecting the fitted state of both connector housings 1 and 9, the operator changes the position of one finger which was holding the male connector housing 1 to the position for pressing the operating plate portion 16 of the fitting detection member 2, and moves the fitting detection member 2 from the initial position to the proper-fitting detecting position.

Further, as the housings-pulling and confirming operation for confirming whether the locked state of the male and female connector housings is incomplete due to the breakage or the like of the lock portion 6 even if the fitting detection member 2 was able to move properly to the proper-fitting detecting position, the operator pulls both connector housings with his or her right and left fingers in the disengaging directions while holding both connector housings, so as to confirm the locked state of the male and female connector housings.

Accordingly, the operator must consecutively perform the above-described three independent operations, so that there has been the problem that the number of operations is large.

In addition, when proceeding to an ensuing operation, on the male connector housing 1 side, the operator on each such occasion needs to change the position of one finger pinching the side surface of the male connector housing 1 to the position on the operating plate portion 16 of the fitting detection member 2 or change the position of the finger placed on the fitting detection member 2 to the side surface of the male connector housing 1. Hence, there has been the problem that the operating efficiency drops due to the change of the position of the finger.

SUMMARY OF THE INVENTION

The invention has been devised in view of the above-described problems, and its object is to provide a half-fitting prevention connector which, at the time of connecting the connector housings, makes it possible to simultaneously complete the detection member moving operation and the housings-pulling and confirming operation in a single operation, thereby making it possible to reduce the number of operations at the time of the connection of the connector housings.

Another object of the invention is to provide a half-fitting prevention connector in which, at the time of proceeding to an ensuing operation, makes it possible to perform the ensuring operation efficiently without needing to change the positions of the fingers holding the housings, thereby making it possible to improve the operating efficiency at the time of connection of the connector housings.

The half-fitting prevention connector of the invention for attaining the above objects is a half-fitting prevention connector including a first connector housing having a flexible lock arm, a second connector housing having an engaging portion for engaging a lock portion of the flexible lock arm and adapted to be connected to the first connector housing by engagement between the lock portion and the engaging portion when the second connector housing is fitted with the first connector housing, and a fitting detection member attached over the first connector housing slidably along a fitting direction of the connector housings so as to detect a half-fitted state of the connector housings according to whether or not the fitting detection member is able to slidingly move, characterized in that:

the fitting detection member has a substantially tubular detection member body which is attached over outer peripheries of the first connector housing slidably along the fitting direction of the connector housings, as well as a positioning portion for restricting the detection member body to an initial position by engagement with the lock portion, wherein before the fitting of the connector housings the fitting detection member is restricted to the initial position by the engagement between the lock portion and the positioning portion, and wherein at the time of complete fitting of the connector housings the fitting detection member slidingly moves from the initial position toward a rear side of the one cancellation operating portion, and is restricted to a proper-fitting detecting position by engagement between the positioning portion and a detection member retaining portion provided in the rear of the lock portion in sad flexible lock arm.

According to the half-fitting prevention connector constructed as described above, before its engagement with the other cancellation operating portion, the fitting detection member attached over one cancellation operating portion is restricted to its initial position by being retained at the lock portion in such a manner as to substantially cover outer peripheries of the one cancellation operating portion. For this reason, at the time of the housings-engaging operation for engaging the pair of male and female connector housings, the engaging operation can be effected with the fitting detection member kept pinched by fingers.

In addition, upon completion of the aforementioned housings-engaging operation, the detection member moving operation is effected to move the fitting detection member from the initial position to the proper-fitting detecting position so as to detect the fitted state of the male and female connector housings.

This detection member moving operation is an operation of moving the fitting detection member toward the rear side of the housing, and when the fitting detection member reaches the proper-fitting detecting position, the positioning portion of the fitting detection member engages the detection member retaining portion in the first connector housing, thereby restricting the sliding movement of the fitting detection member. At this time, the fitting detection member can be moved by being merely pulled toward the rear side of the housing without changing the fingers which were pinching the fitting detection member at the time of the housings-engaging operation.

Subsequently, if the fitting detection member is further pulled toward the rear side of the housing, the housings-pulling and confirming operation can be effected in which the housings are pulled away from each other in the disengaging directions. Namely, the housings-pulling and confirming operation is an operation of moving the fitting detection member toward the rear side of the housing, and its urging direction is the same as that of the detection member moving operation. Hence, in the same pulling operation for effecting the detection member moving operation, the operation can be completed at a stroke including the housings-pulling and confirming operation.

In addition, the half-fitting prevention connector of the invention is the above-described half-fitting prevention connector and is characterized in that in the initial position the length of the fitting detection member is preferably set such that the fitting detection member does not project from a rear end of the first connector housing.

According to the half-fitting prevention connector constructed as described above, it is possible to perform automatic insertion of connection terminals by an automatic terminal-inserting machine from the rear side of the first connector housing over which the fitting detection member is fitted.

In addition, the half-fitting prevention connector of the invention is the above-described half-fitting prevention connector and is characterized in that, at the time of the complete fitting of the connector housings, the positioning portion is preferably pushed out by the lock portion in conjunction with the engagement of the retaining portion with the lock portion, thereby canceling a state of the engagement of the positioning portion with the lock portion.

According to the half-fitting prevention connector constructed as described above, if the fitting detection member is moved toward the rear side of the housing, the fitting detection member reaches the proper-fitting detecting portion, and the positioning portion engages the detection member retaining portion. In consequence, the sliding movement of the fitting detection member toward the rear side of the housing is restricted, and the fitting detection member is then further pulled toward the rear side of the housing, thereby effecting the housings-pulling and confirming operation in which the connector housings are pulled away from each other in the disengaging directions.

Accordingly, when the connector housings are connected to each other, the detection member moving operation and the housings-pulling and confirming operation can be effected smoothly in a single operation, so that it is possible to reduce the number of operations at the time of the connection of the connector housings.

DETAILED DESCRIPTION OF THE PREFERRED EMBODIMENTS

Figure 1:
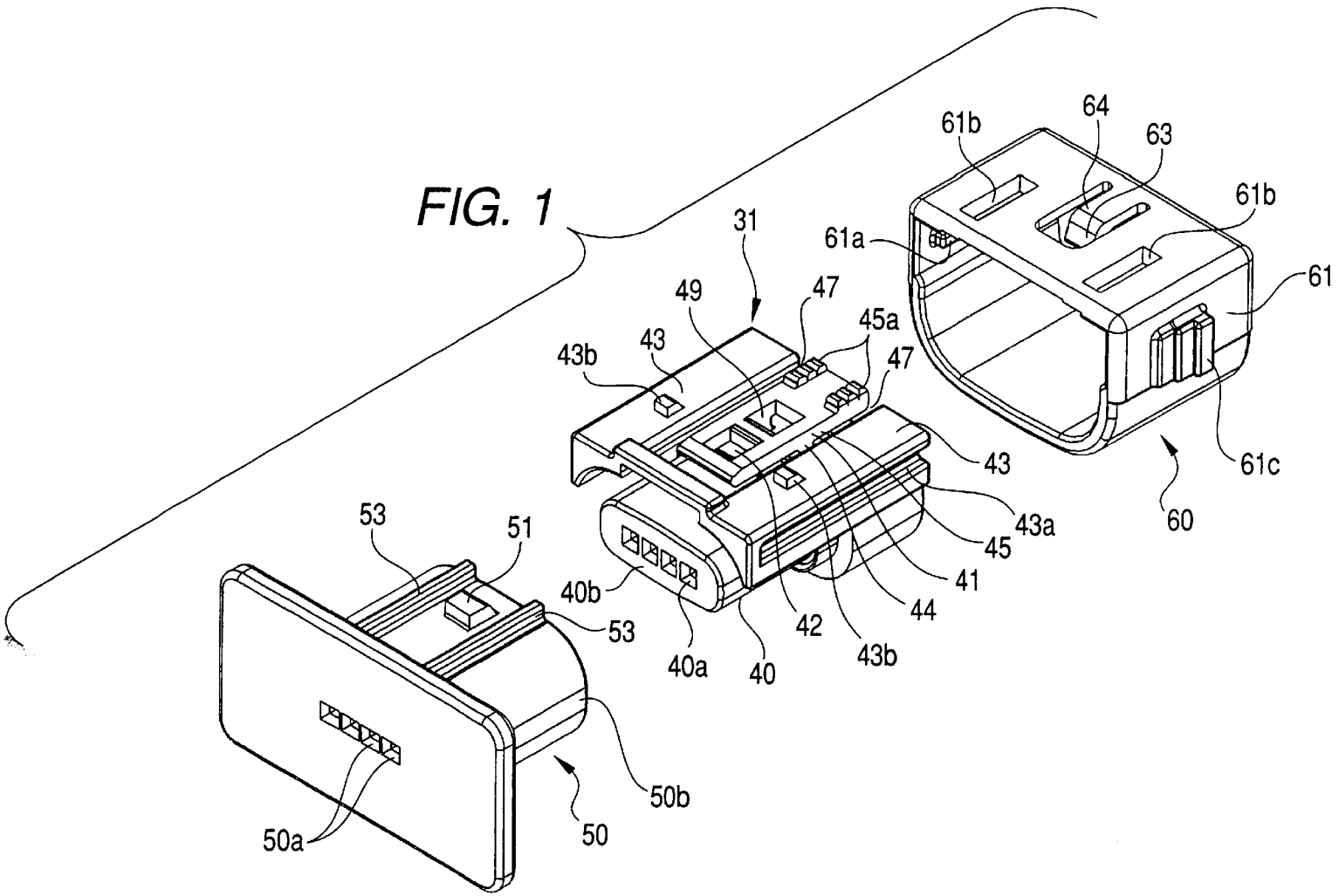
FIG. 1 is an exploded perspective view illustrating an embodiment of the half-fitting prevention connector in accordance with the invention.
Figure 2:
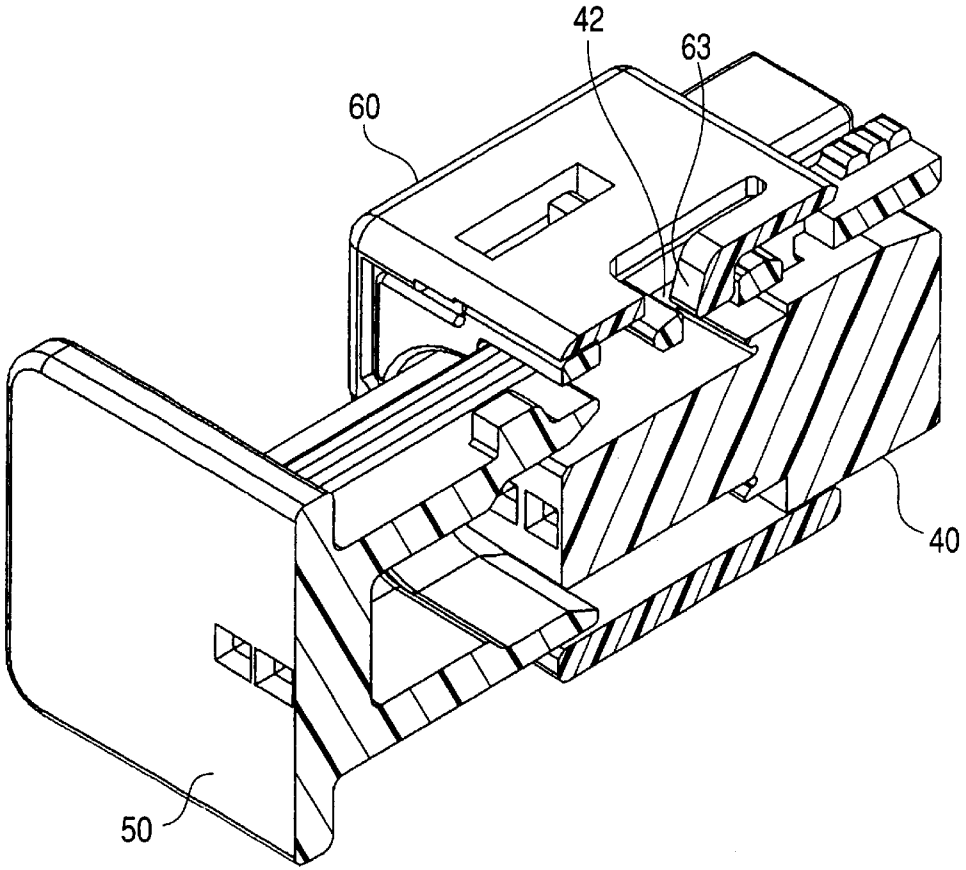
FIG. 2 is a perspective view illustrating a state in an initial period of fitting in FIG. 1.
Figure 3:
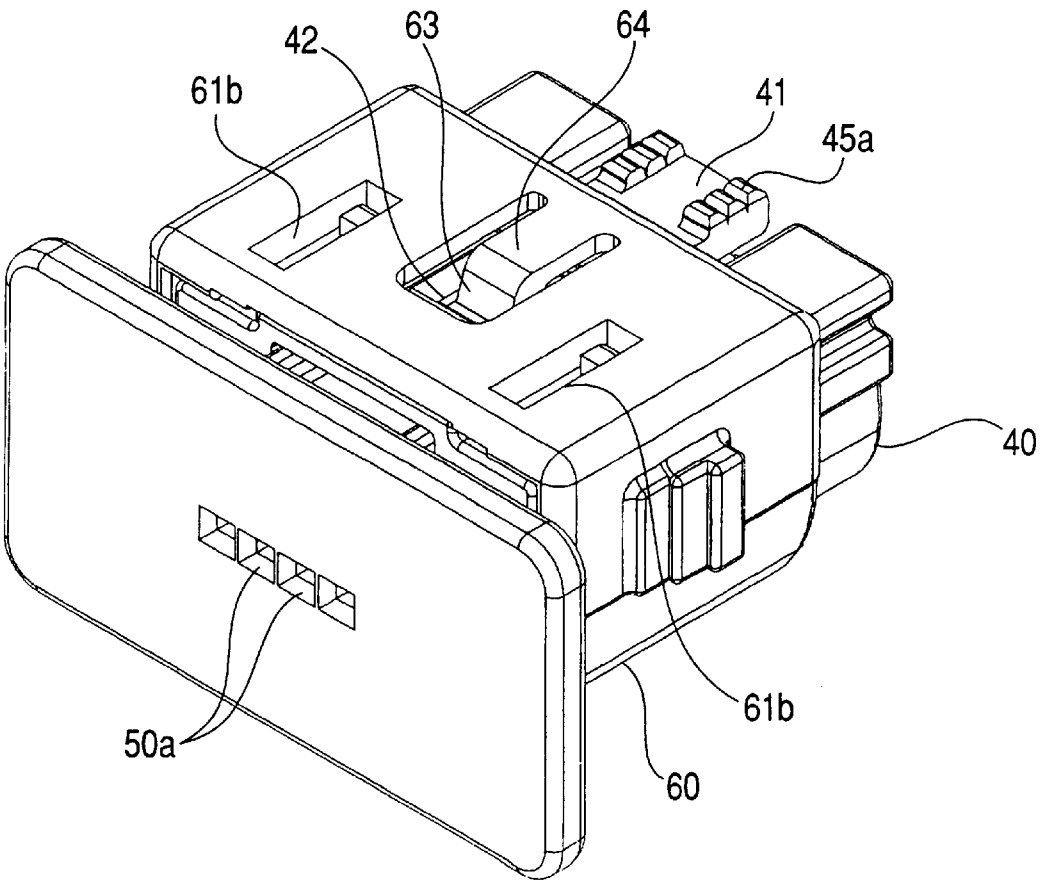
FIG. 3 is a perspective view illustrating a state of completion of the fitting in FIG. 1.
Figure 4:
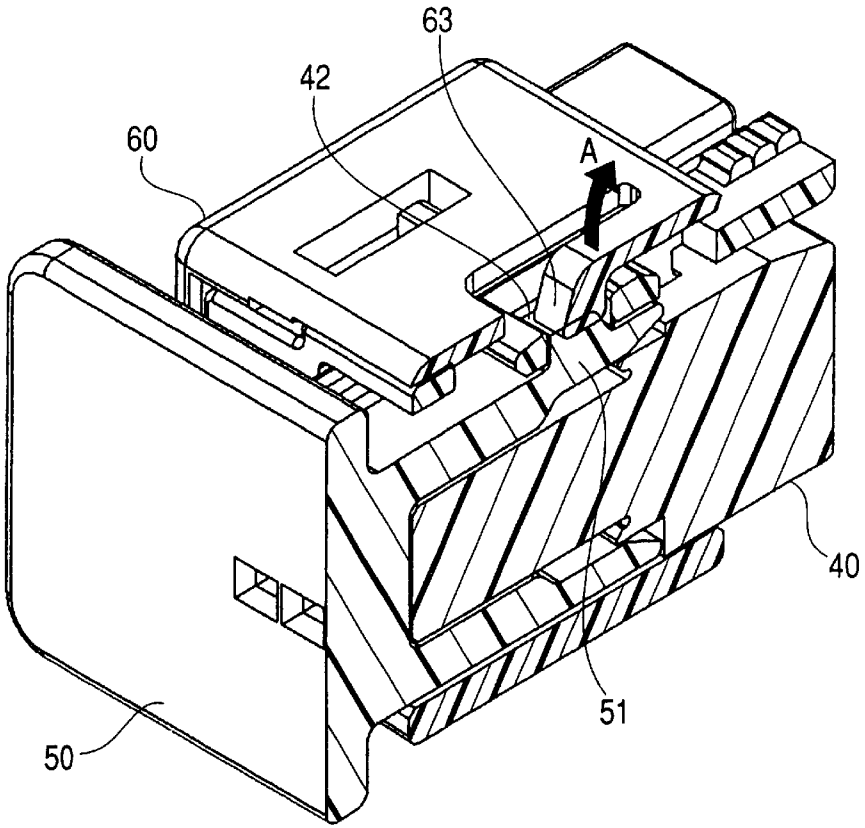
FIG. 4 is a perspective view having a vertical cross section in FIG. 3.
Figure 5:
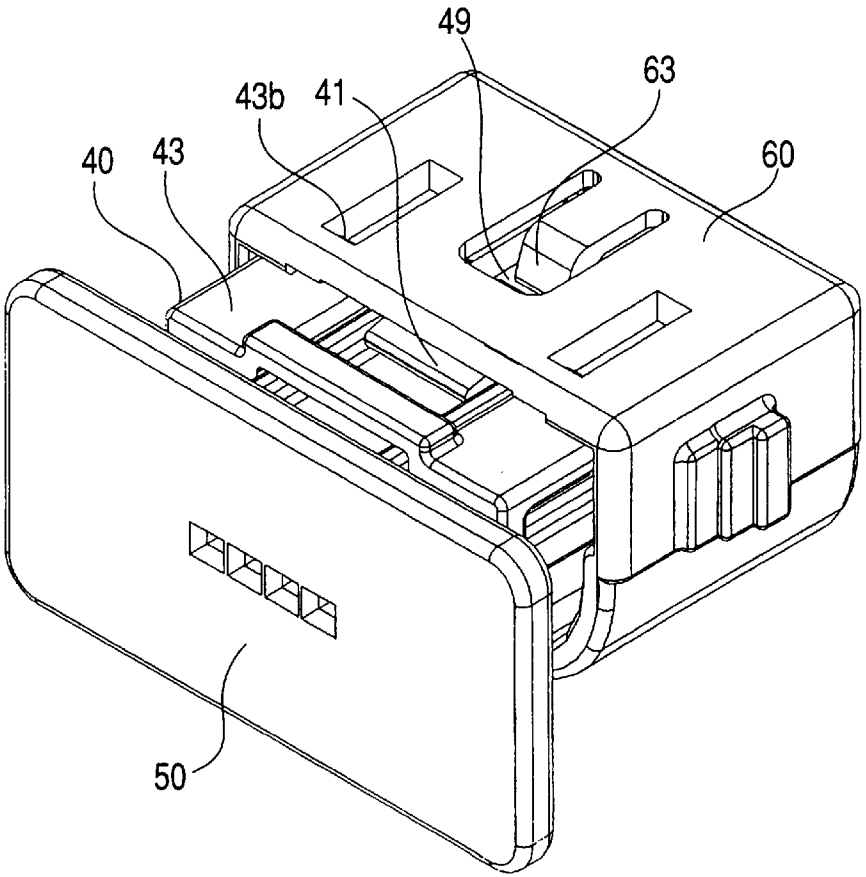
FIG. 5 is a perspective view illustrating a state in which a fitting detection member in FIG. 1 has been slid to a proper-fitting detecting position.
Figure 6:
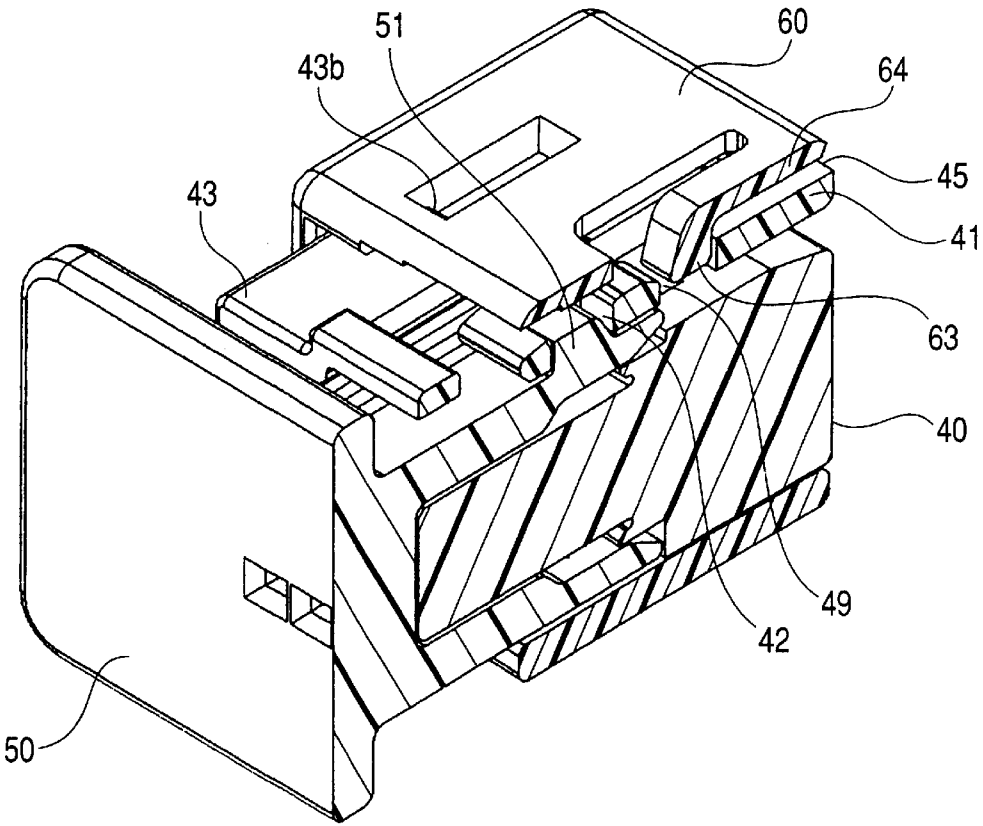
FIG. 6 is a perspective view having a vertical cross section in FIG. 5.
Figure 7:
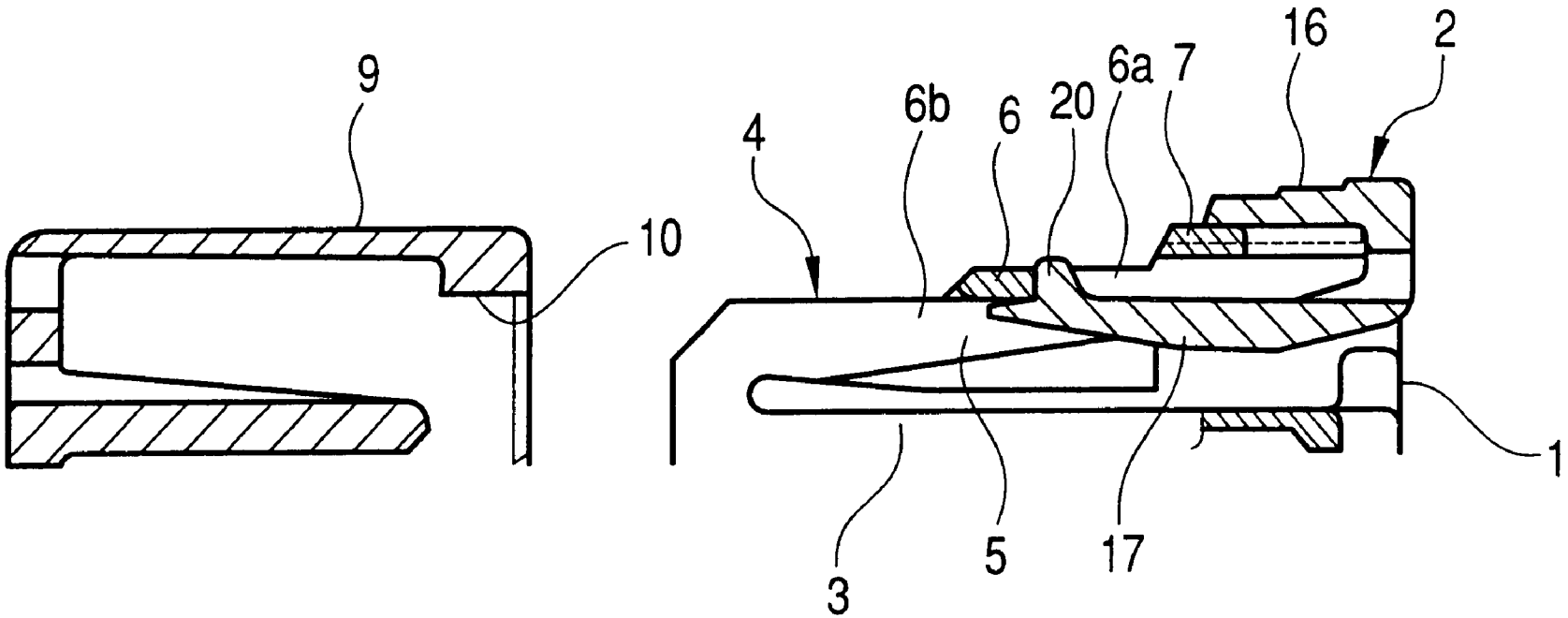
FIG. 7 is a vertical cross-sectional view illustrating a state persisting prior to the fitting of a conventional half-fitting prevention connector.
Figure 8:
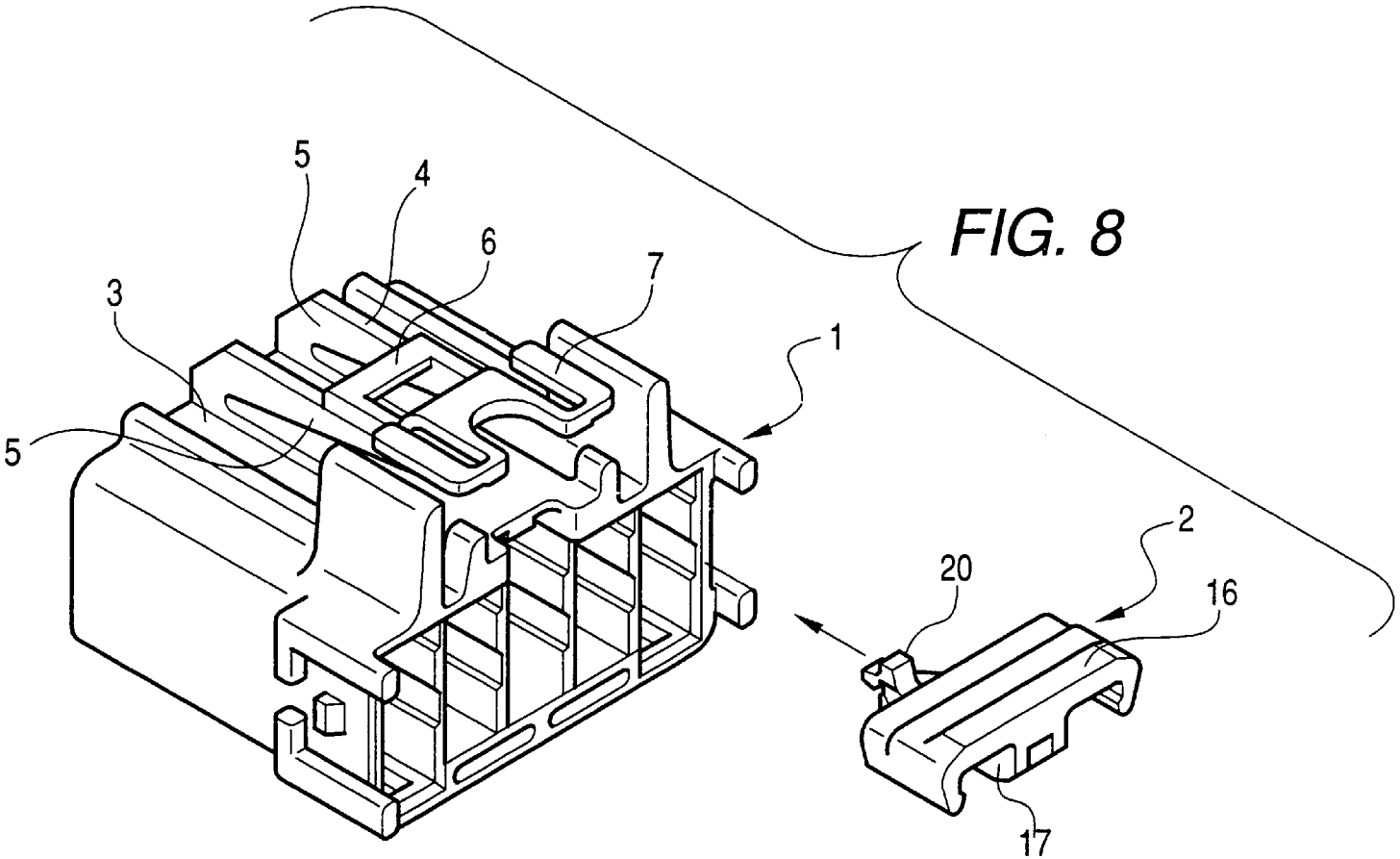
FIG. 8 is an exploded perspective view of a male connector housing and a fitting detection member shown in FIG. 7.
Figure 9:
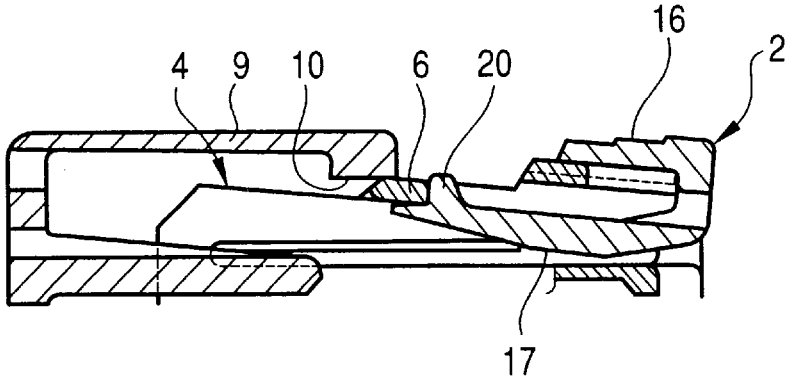
FIG. 9 is a partial vertical dross-sectional view of essential portions illustrating a state in the process fitting in FIG. 7.
Figure 10:
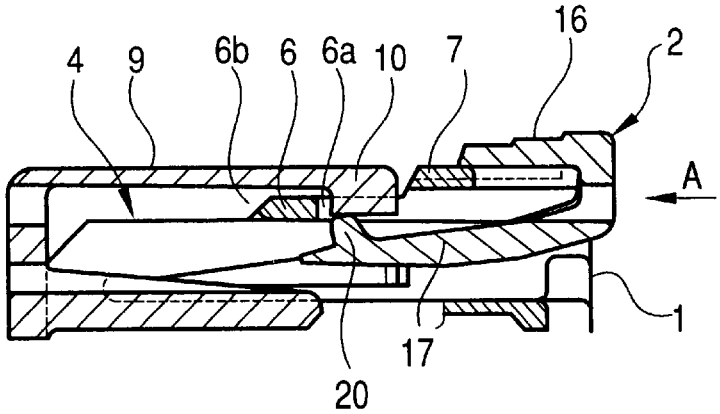
FIG. 10 is a partial cross-sectional view illustrating a state in which an engaging portion of the second connector housing has engaged a lock portion of first connector housing in FIG. 7.
Figure 11:
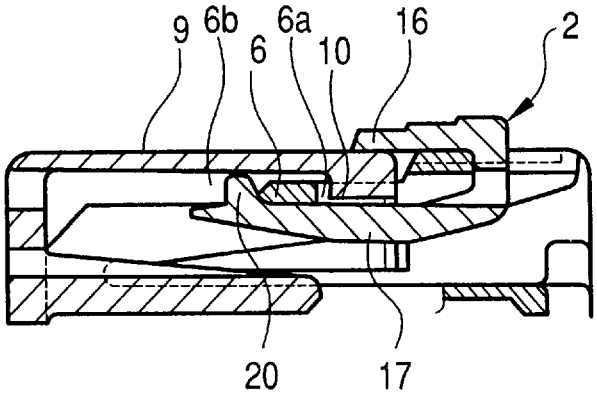
FIG. 11 is a partial cross-sectional view illustrating a state in which the fitting of the connector housings in FIG. 7 has been completed, and the sliding movement of a fitting detection member to a proper-fitting detecting position has been completed.

Referring now to FIGS. 1 to 6, a detailed description will be given of a preferred embodiment of the half-fitting prevention connector in accordance with the invention. FIG. 1 is an exploded perspective view illustrating an embodiment of the half-fitting prevention connector in accordance with the invention. FIG. 2 is a perspective view illustrating a state in an initial period of fitting in FIG. 1. FIG. 3 is a perspective view illustrating a state of completion of the fitting in FIG. 1. FIG. 4 is a perspective view having a vertical cross section in FIG. 3. FIG. 5 is a perspective view illustrating a state in which a fitting detection member in FIG. 1 has been slid to a proper-fitting detecting position. FIG. 6 is a perspective view having a vertical cross section in FIG. 5.

As shown in FIG. 1, a half-fitting prevention connector 31 of this embodiment is comprised of a female connector 40 which is first connector housing having a flexible lock arm 41; a male connector 50 which is the second connector housing having an engaging projection 51 as an engaging portion which is engaged in a retaining hole 42, i.e., a lock portion provided in the flexible lock arm 41; and a substantially tubular fitting detection member 60 which is attached over the female connector 40 slidably along the fitting direction.

Namely, before the fitting of the connectors the fitting detection member 60 is restricted to its initial position by the retaining hole 42. Upon completion of the fitting of the connectors, the positional restriction of the fitting detection member 60 by the retaining hole 42 is canceled, allowing the fitting detection member 60 to slidingly move to the proper-fitting detecting position in the rear of the female connector 40 so as to be restricted by a detection member retaining portion 49. Accordingly, a half-fitted state of the male and female connectors 50 and 40 can be detected according to whether or not the fitting detection member 60 is able to slidingly move to the proper-fitting detecting position.

The female connector 40 of this embodiment has a structure in which a housing body 40*b* having terminal accommodating chambers 40*a* formed therein for accommodating and holding unillustrated female connection terminals, the flexible lock arm 41 formed on an upper surface of the housing body 40*b*, and a pair of guide portions 43 for slidably supporting the fitting detection member 60 are integrally molded.

The flexible lock arm 41 is formed such that an arm portion 45 extending along the back-and-forth direction of the housing body 40*b* is connected to an upper end of a column portion 44 provided uprightly substantially in the center of the upper surface of the housing body 40*b*. The arrangement provided is such that the arm portion 45 is displaceable in the manner of a seesaw vertically with the column portion 44 as a fulcrum.

In addition, the retaining hole 42 in the flexible lock arm 41 is provided at a position close to a front end of the arm portion 45. Further, a pair of cancellation operating portions 45*a* for upwardly displacing the front end of the arm portion 45 are provided on the upper surface of the arm portion 45 at a position close to a rear end thereof.

Accordingly, in the state in which the male and female connectors 50 and 40 are engaged and the engaging projection 51 of the male connector 50 is engaged in the retaining hole 42, if the cancellation operating portions 45*a* are pressed down to upwardly displace the front end of the arm portion 45, the state of engagement between the engaging hole 42 and the engaging projection 51 can be canceled.

In addition, provided in the rear of the retaining hole 42 in the flexible lock arm 41 is the detection member retaining portion 49 for restricting the sliding movement of the fitting detection member 60 by engagement between the detection member retaining portion 49 and a retaining projection (positioning portion) 63, which will be described later, when the fitting detection member 60 has slidingly moved from the initial position to the proper-fitting detecting position.

The detection member retaining portion 49 is a retaining hole formed through the arm portion 45 in the same way as the aforementioned retaining hole 42, and fixes the fitting detection member 60 at the proper-fitting detecting portion as the retaining projection 63 is fitted in the detection member retaining portion 49 when the fitting detection member 60 has slidingly moved from the initial position to the proper-fitting detecting position.

In addition, the pair of guide portions 43 are respectively provided both sides of the upper surface of the housing body 40*b*. Each of these guide portions 43 has in an outer surface portion a guide slot 43*a* extending along the back-and-forth direction of the housing body 40*b*. Further, a guide projection 43*b* is formed on the upper surface of each guide portion 43.

Next, the fitting detection member 60 of this embodiment has a substantially tubular detection member body 61 which is attached over outer peripheries of the female connector 40 slidably along the fitting direction of the male and female connectors 50 and 40, as well as the retaining projection 63 for restricting the detection member body 61 to its initial position by its engagement with the retaining hole 42.

In addition, the length of the fitting detection member 60 is set such that the rear end of the fitting detection member 60 does not project rearwardly of the rear end of the female connector 40 when the fitting detection member 60 is at the initial position over the female connector 40.

As for the detection member body 61, a pair of protrusions 61*a* which slidably fit in the guide slots 43*a* of the guide portions 43 are respectively formed on both inner side surfaces, and a pair of slits 61*b* into which the guide projections 43*b* are fitted are formed in the upper wall surface. Further, the detection member body 61 is attached over the female connector 40 slidably along the fitting direction of the housings by the engagement between the guide slots 43*a* and the protrusions 61*a* and the engagement between the guide projections 43*b* and the slits 61*b*.

In addition, a pair of nonslip portions 61*c* which are pinched by fingers when the detection member body 61 is slidingly moved are respectively provided on both outer side surfaces.

The retaining projection 63 is projectingly provided on a lower portion of a distal end of a retaining arm 64, which is a resilient piece forming a portion of the upper wall of the detection member body 61, and the retaining projection 63 is upwardly displaceable resiliently. This retaining projection 63 is fitted from above into the retaining hole 42 with its front end face abutting against the front end face of the retaining hole 42, so as to allow the fitting detection member 60 to be engaged in the initial position.

The length of each slit 61*b* is set in correspondence with the sliding length of the fitting detection member 60 from the initial position to the proper-fitting detecting portion. When the fitting detection member 60 is located in the initial position, rear end faces of the guide projections 43*b* abut against rear edges of the slits 61*b*, thereby restricting the movement of the fitting detection member 60 toward the forward side of the housing.

In addition, when the fitting detection member 60 is located at the proper-fitting detecting portion, front end faces of the guide projections 43*b* abut against front edges of the slits 61*b*, thereby restricting the movement of the fitting detection member 60 toward the rear side of the housing.

Next, the male connector 50 of this embodiment includes the engaging projection 51 adapted to engage the retaining hole 42 and formed on an upper surface of a housing body 50*b* in which a plurality of terminal accommodating chambers 50*a* for accommodating male connection terminals are formed, as well as a pair of protruding portions 53 which are each adapted to be passed through a gap 47 formed between the flexible lock arm 41 and the guide portion 43.

The terminal accommodating chambers 50*a* are for accommodating and holding the unillustrated male connection terminals which are connected to the female connection terminals accommodated in the terminal accommodating chambers 40*a* of the female connector 40. The terminal accommodating chambers 50*a* are formed with the same pitch of arrangement as that of the terminal accommodating chambers 40*a*.

In addition, the engaging projection 51 is projectingly provided on the upper surface of the housing body 50*b* at a position close to a front end thereof, and when the male and female connectors 50 and 40 are fitted with each other, the engaging projection 51 advances in sliding contact with a lower surface of the arm portion 45 of the flexible lock arm 41, and is fitted in the retaining hole 42.

In addition, the protruding portions 53, when passed through the gaps 47 on the female connector 40 side, restrict the engaging directions and engaging positions of the male and female connectors 50 and 40, thereby making the fitting operation of the male and female connectors 50 and 40 smooth.

According to the half-fitting prevention connector 31 constructed as described above, as shown in FIG. 2, before the fitting of the male and female connectors 50 and 40, the fitting detection member 60 attached over the female connector 40 is restricted to its initial position by being retained at the retaining hole 42 of the female connector 40 in such a manner as to cover the female connector 40.

For this reason, at the time of the housings-engaging operation for engaging the male and female connectors 50 and 40, the engaging operation until complete fitting can be easily effected by pinching the fitting detection member 60 itself and the mating male connector 50 without needing to hold the female connector 40 itself with fingers.

Next, at the time of the operation of engaging the male and female connectors 50 and 40, as shown in FIGS. 3 and 4, the length of fitting of the housings reaches a predetermined value, and the engaging projection 51 of the male connector 50 is fitted into the retaining hole 42 from below. The completely fitted state of the male and female connectors 50 and 40 is locked by this engagement between the engaging projection 51 and the retaining hole 42.

At this time, as shown by arrow A in FIG. 4, the retaining projection 63 of the fitting detection member 60 which was retained in the retaining hole 42 is pushed out upward by the engaging projection 51, thereby canceling the positional restriction of the fitting detection member 60 to its initial position. Accordingly, the fitting detection member 60 becomes movable toward the rear side of the female connector 40.

Then, as shown in FIGS. 5 and 6, upon completion of the housings-engaging operation, the detection member moving operation is effected to move the fitting detection member 60 from the initial position to the proper-fitting detecting position so as to detect the fitted state of the male and female connectors 50 and 40. Namely, the detection member moving operation for detecting the completely fitted state of the male and female connectors 50 and 40 can be effected by pulling the fitting detection member 60 toward the rear side of the housing without changing the fingers which were pinching the fitting detection member 60 at the time of the housings-engaging operation.

The detection member moving operation is an operation of moving the fitting detection member 60 toward the rear side of the housing, and when the fitting detection member 60 reaches the proper-fitting detecting portion, the retaining projection 63 of the fitting detection member 60 engages the detection member retaining portion 49 in the female connector 40. In consequence, the sliding movement of the fitting detection member 60 toward the rear side of the housing is restricted, and if the fitting detection member 60 is then further pulled toward the rear side of the housing, that tensile force is transmitted to the female connector 40 by means of the fitting detection member 60, thereby effecting the housings-pulling and confirming operation in which the housings are pulled away from each other in the disengaging directions.

Namely, after the fitting detection member 60 reached the proper-fitting detecting position, if the fitting detection member 60 is further pulled in the same direction, the series of operations ranging from the detection member moving operation to the housings-pulling and confirming operation can be completed at a stroke.

Accordingly, when the male and female connectors 50 and 40 are connected, the detection member moving operation and the housings-pulling and confirming operation can be effected smoothly by a single operation, thereby making it possible to reduce the number of operations at the time of connection of the male and female connectors 50 and 40. Furthermore, at the time of proceeding to the ensuing operation, it is possible to proceed to the ensuring operation without changing the positions of the fingers holding the male connector 50 and the fitting detection member 60, it possible to improve the operating efficiency in the connecting operation for connecting the male and female connectors 50 and 40 and the series of operations in general.

In addition, in the half-fitting prevention connector 31 in accordance with this embodiment, since the rear end of the fitting detection member 60 does not project rearwardly of the rear end of the female connector 40 when the fitting detection member 60 is at its initial position on the female connector 40, it is possible to perform automatic insertion of the connection terminals by an automatic terminal-inserting machine from the rear side of the female connector 40.

As described above, after the male and female connectors 50 and 40 are fitted and connected by the housings-engaging operation, the detection member moving operation and the housings-pulling and confirming operation can be completed smoothly in a single operation, so that it is possible to reduce the number of operations at the time of the fitting and connection of the male and female connectors.

In addition, the setting is provided such that when the fitting detection member is at its initial position, the rear end of the fitting detection member 60 does not project from the rear end of the female connector 40, whereas when it is located at the proper-fitting detecting position, the rear end of the fitting detection member 60 substantially coincides with the rear end of the female connector 40. Accordingly, by visually confirming whether or not the rear end of the fitting detection member 60 substantially coincides with the rear end of the female connector 40 at the time of such as maintenance and inspection, it is possible to easily detect whether the fitting detection member 60 is at the initial position or the proper-fitting detecting position. Hence, it is possible to facilitate the operation of confirming the position of the fitting detection member at the time of such as maintenance and inspection.

Different colors are provided for the outer surfaces of the fitting detection member 60 and the outer surfaces of the female connector 40 exposed from the fitting detection member 60 so that a clear change in color occurs in the external appearance when the fitting detection member 60 is located in the initial position and the proper-fitting detecting portion.

Accordingly, at the time of such as maintenance and inspection, whether the fitting detection member 60 is at the initial position or the proper-fitting detecting portion can also be easily confirmed by visually observing the color pattern formed by the female connector 40 and the fitting detection member 60. Hence, the operation of confirming the position of the fitting detection member 60 at the time of such as maintenance and inspection can be facilitated.

As described above, in accordance with the half-fitting prevention connector of the invention, the fitting detection member has a substantially tubular detection member body which is attached over outer peripheries of the first connector housing slidably along the fitting direction of the connector housings, as well as a positioning portion for restricting the detection member body to an initial position by engagement with the lock portion. Before the fitting of the connector housings, the fitting detection member is restricted to the initial position by the engagement between the lock portion and the positioning portion. At the time of complete fitting of the connector housings, the fitting detection member slidingly moves from the initial position toward a rear side of the one cancellation operating portion, and is restricted to a proper-fitting detecting position by engagement between the positioning portion and a detection member retaining portion provided in the rear of the lock portion in sad flexible lock arm.

According to the half-fitting prevention connector constructed as described above, before its engagement with the other cancellation operating portion, the fitting detection member attached over one cancellation operating portion is restricted to its initial position by being retained at the lock portion in such a manner as to substantially cover outer peripheries of the one cancellation operating portion. For this reason, at the time of the housings-engaging operation for engaging the pair of male and female connector housings, the engaging operation can be effected with the fitting detection member kept pinched by fingers. Accordingly, it is possible to efficiently perform the operation of engaging the male and female connector housings.

In addition, in the detection member moving operation which is performed upon completion of the above-described housings-engaging operation, the fitting detection member is moved toward the rear side of the housing, and the fitting detection member reaches the proper-fitting detecting position to restrict the sliding movement of the fitting detection member, thereby making it possible to easily detect the completely fitted state of the male and female connector housings.

Subsequently, if the fitting detection member is further pulled toward the rear side of the housing, the housings-pulling and confirming operation can be effected in which the housings are pulled away from each other in the disengaging directions. Since the urging direction is the same as that of the detection member moving operation, in the pulling operation for effecting the detection member moving operation, the operation can be completed at a stroke including the housings-pulling and confirming operation. Accordingly, it is possible to efficiently perform the operation of detecting the fitted state of the male and female connector housings.

In addition, the half-fitting prevention connector of the invention is the above-described half-fitting prevention connector and is characterized in that in the initial position the length of the fitting detection member is preferably set such that the fitting detection member does not project from a rear end of the first connector housing.

According to the half-fitting prevention connector constructed as described above, it is possible to perform automatic insertion of connection terminals by an automatic terminal-inserting machine from the rear side of the first connector housing over which the fitting detection member is fitted. Hence, the operation of inserting the connection terminals into the first connector housing can be performed efficiently, thereby making it possible to improve productivity.

In addition, the half-fitting prevention connector of the invention is the above-described half-fitting prevention connector and is characterized in that, at the time of the complete fitting of the connector housings, the positioning portion is preferably pushed out by the lock portion in conjunction with the engagement of the retaining portion with the lock portion, thereby canceling the state of engagement with the lock portion.

According to the half-fitting prevention connector constructed as described above, by moving the fitting detection member toward the rear side of the housing, the positioning portion engages the detection member retaining portion. Subsequently, by further pulling the fitting detection member toward the rear side of the housing, the housings-pulling and confirming operation is effected. Accordingly, when the connector housings are connected to each other, the detection member moving operation and the housings-pulling and confirming operation can be effected smoothly in a single operation, so that it is possible to reduce the number of operations at the time of the connection of the connector housings.

What is claimed is:

1. A half-fitting prevention connector comprising:

a first connector housing having a flexible lock arm;

a second connector housing having an engaging portion for engaging a lock portion of said flexible lock arm so as to be connected to said first connector housing by engagement between said lock portion and said engaging portion when said second connector housing is fitted with said first connector housing; and a fitting detection member attached over said first connector housing slidably along a fitting direction of said first and second connector housings to thereby detect a half-fitted state of said first and second connector housings according to whether or not said fitting detection member is movable, said fitting detection member including a substantially tubular detection member body which is attached over outer peripheries of said first connector housing slidably along the fitting direction of said first and second connector housings, and a positioning portion for restricting said detection member body to an initial position by engagement with said lock portion, wherein before the fitting of said first and second connector housings, said fitting detection member is restricted to the initial position by the engagement between said lock portion and said positioning portion, and when said first and second connector housings are completely fitted with each other, said fitting detection member slidingly moves from the initial position toward a rear side of said first connector housing, and is restricted to a proper-fitting detecting position by engagement between said positioning portion and a detection member retaining portion provided in the rear of said lock portion in sad flexible lock arm.

2. The half-fitting prevention connector according to claim 1, wherein when said fitting detection member is at the initial position, a length of said fitting detection member is set such that said fitting detection member does not project from a rear end of said first connector housing.

3. The half-fitting prevention connector according to claim 1, wherein at the time of the complete fitting of said first and second connector housings, said positioning portion is pushed out by said lock portion by the engagement of said retaining portion with said lock portion, thereby canceling an engagement of said positioning portion with said lock portion.

* * * * *